US005604777A

United States Patent [19]

Raymond et al.

[11] Patent Number: 5,604,777

[45] Date of Patent: Feb. 18, 1997

[54] NUCLEAR REACTOR COOLANT PUMP

[75] Inventors: James R. Raymond, Allegheny; Clarence I. Thomson, III, Murrysville, both of Pa.

[73] Assignee: Westinghouse Electric Corporation, Pittsburgh, Pa.

[21] Appl. No.: 403,041

[22] Filed: Mar. 13, 1995

[51] Int. Cl.[6] ..... G21C 19/307

[52] U.S. Cl. ..... 376/310; 376/402

[58] Field of Search ..... 376/310, 402, 376/404, 406, 463

[56] References Cited

U.S. PATENT DOCUMENTS

| | | | |
|---|---|---|---|
| 2,763,214 | 9/1956 | White | 103/87 |
| 2,993,449 | 7/1961 | Harland | 103/87 |
| 4,275,891 | 6/1981 | Boes | 277/96.1 |
| 4,564,500 | 1/1986 | Keady | 376/463 |
| 4,780,061 | 10/1988 | Butterworth | 417/371 |
| 4,878,804 | 11/1989 | Akerman et al. | 415/111 |
| 4,886,430 | 12/1989 | Veronesi et al. | 417/423.13 |
| 5,118,466 | 6/1992 | Raymond et al. | 376/404 |
| 5,126,101 | 6/1992 | Nakayama et al. | 376/310 |
| 5,143,515 | 9/1992 | Boster et al. | 376/402 |
| 5,165,305 | 11/1992 | Veronesi | 74/574 |

*Primary Examiner*—Daniel D. Wasil

[57] ABSTRACT

In a nuclear reactor water cleanup pump, a purge fluid is continuously delivered during at least the operation of the pump into the cavities containing the bearings and the electrical motor at a desired flow rate. The desired flow rate being based on the heat loss from said pump and a differential temperature defined as being the difference between the predetermined temperature of the purge fluid delivered into the pump and the desired temperature for the purge fluid exiting the pump.

3 Claims, 3 Drawing Sheets

NUCLEAR REACTOR COOLANT PUMP

BACKGROUND OF THE INVENTION

1. Field of the Invention

The present invention relates generally to a nuclear reactor water cleanup pump and, more particularly, is concerned with a method and a means for internally cooling the nuclear reactor cleanup pump of a boiling water reactor.

2. Description of the Prior Art

In boiling water nuclear power plants, a reactor coolant system is used to transport heat from a reactor core to steam generators for the production of steam. The steam is then used to drive a turbine generator. During the process, a substantial amount of mineral deposits are formed in the reactant coolant, which necessitates "cleanup" of the coolant. A coolant recirculation system is utilized whereby cleanup pumps transport the reactant coolant from the reactor to a demineralizer from where the reactant coolant is delivered back into the reactor.

The reactor cleanup pump generally has a "canned" motor which is totally contained and requires little maintenance. A purge fluid system is generally provided for forcing any mineral deposits in the pump out of the canned motor and bearings during start-up, hot-standby, and/or shut-down operations of the pump. The temperature of the reactor coolant water is typically in the range of from approximately 500° to 600° F. which is too hot to also use to cool the motor and bearings of the cleanup pump. Thus, a heat removal system separate from, and which does not employ the reactor coolant water has been generally utilized in the prior art. One type of heat removal system is a heat exchanger which is comprised of an annular hollow jacket surrounding the motor and a set of coils contained in the jacket and surrounding the motor. Other sets of coils may be located adjacent to the upper and/or the lower beatings. The multiple sets of coils are connected in flow communication so as to define a closed path for circulation of an internal coolant fluid therein for cooling the bearings and the motor.

The annular jacket of the heat removal arrangement has an inlet and an outlet connected in flow communication with an external source of a secondary coolant fluid, separate from the reactor coolant water and separate from the purge fluid, which then flows through the jacket over the set of coils contained therein. The secondary coolant fluid is typically at a temperature much lower than the temperature of the internal coolant fluid circulating about the closed path such that the heat carded by the internal coolant fluid gained from cooling the motor and bearings is readily transferred to the secondary coolant fluid through the one set of coils in the jacket.

A drawback of this type of heat removal arrangement is that it increases the complexity of the cleanup pump.

It has been proposed in the past to use the purge fluid system as a heat removal means where an intermittent flow of purge fluid is delivered into the cleanup pump. However, this idea had not been fully developed and, therefore, was never utilized.

There remains, therefore, a need for providing a more simple, less complicated way for cooling an electrical motor and bearings of a nuclear reactor water cleanup pump of a boiling water reactor.

This and other needs are satisfied by the present invention.

SUMMARY OF THE INVENTION

The present invention provides a method and a means for particularly removing the heat losses from an electrical motor and any heat generated in the bearings of a nuclear reactor water cleanup pump used for transporting the primary reactant fluid from a reactor core into a cooling/cleaning system and back into the reactor core.

Briefly, the present invention provides a method and a means for continuously supplying a sufficient amount of purge fluid into the low pressure side of a cleanup pump at least during the operation of the cleanup pump. The purge fluid may first enter the cavity of the pump containing thrust and radial beating assemblies. From there, the purge fluid may flow into a cavity containing electrical motor means, through an annulus formed between a canned stator and a canned rotor of the electrical motor means, into a cavity containing a further radial bearing assembly, and into an impeller assembly where the purge fluid is discharged with the reactor coolant, from the high pressure side of the cleanup pump.

A desired flow rate for said purge fluid is determined mainly from the heat losses in the electrical motor means and a temperature differential defined as being the difference between the temperature of the purge fluid entering the cleanup pump and the temperature of the purge fluid exiting into the outlet side of the cleanup pump where the purge fluid flows into the primary reactant coolant and is discharged from the cleanup pump. This desired flow rate is, therefore, based on the following:

$$Q_{out}=(\text{unit conversion factor})\times\text{desired flow rate}\times\Delta T$$

where $Q_{out}$ is the heat losses of the electrical motor pump, and $\Delta T$ is the temperature differential between the temperature of the purge fluid entering the pump and the temperature of the purge fluid flowing into the reactant coolant. This equation is then solved for the desired flow rate.

It is, therefore, an object of the present invention to provide an improved method and means for cooling an electrical motor means and possibly the bearings of a cleanup pump for a boiling water reactor which results in a more simplified design for a cleanup pump.

More particularly, the present invention employs a method and means for cooling the electrical motor means and the bearings of a cleanup pump, which eliminate the need for an external cooling jacket-coil system such as the type of heat exchange system of prior designs of a cleanup pump.

A still further object of the present invention is to provide a method and means for removing the heat due to losses in the electrical motor and due to friction in the bearing assemblies of a cleanup pump by continuously delivering cold purge fluid into the cavities containing the electrical motor means and the bearing assemblies.

And a still further object of the present invention is to provide a method for internally cooling an electrical motor means and bearings of a reactor water cleanup pump whereby external cooling means are not required.

These and other objects of the present invention will be more fully understood from the following description of the invention on reference to the drawings attached hereto.

DESCRIPTION OF THE PREFERRED EMBODIMENT

Figure 1:
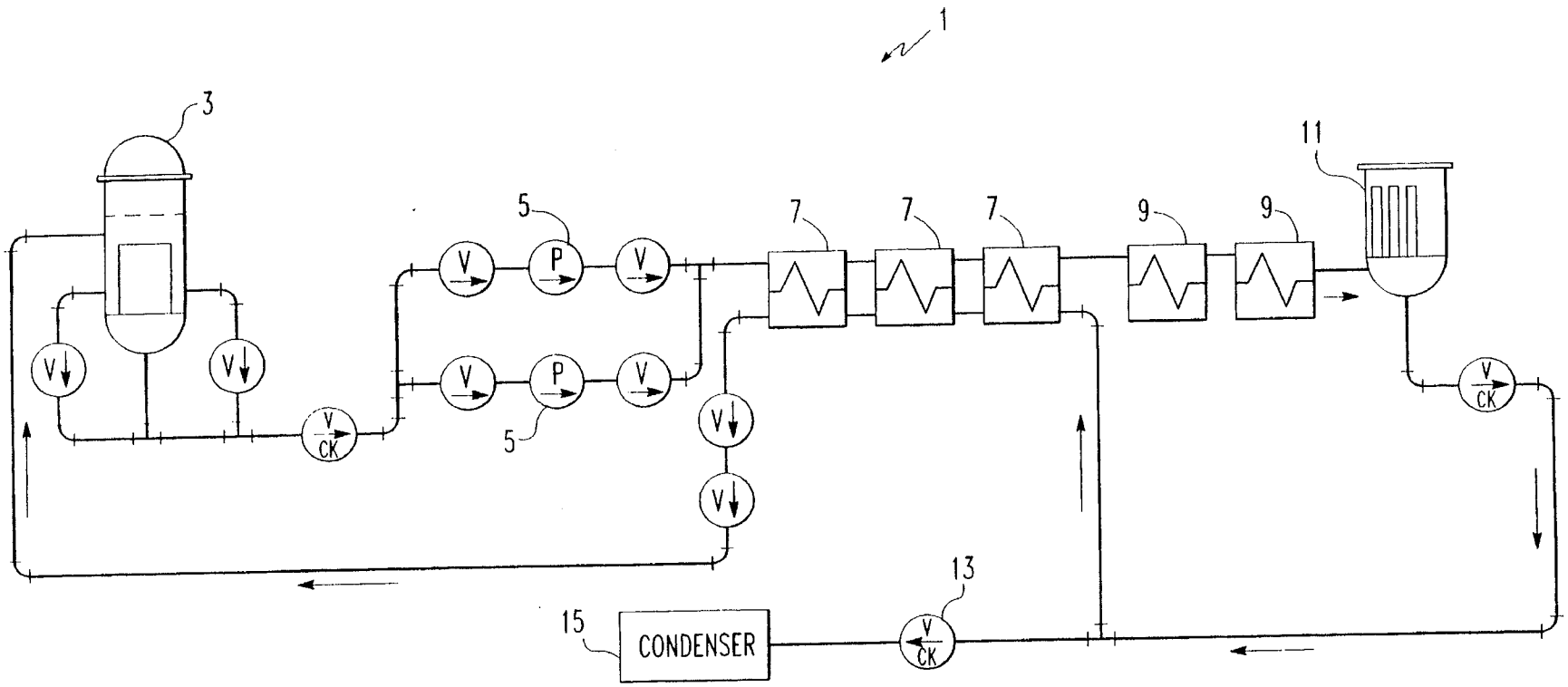
FIG. 1 is a schematic for a boiling water reactor system in which a cleanup pump featuring the present invention is employed.

In the following description, like reference characters designate like or corresponding parts throughout the several views.

Referring now to the drawings, and particularly to FIG. 1, there-is shown a schematic of a typical reactor water cleanup (RWCU) recirculation system generally indicated at 1 for a boiling water reactor (BWR) 3 whereby the reactant coolant is removed from reactor 3 by reactor water cleanup pumps 5. From pumps 5, the reactant coolant is transported through several regenerative heat exchangers 7 and through non-regenerative heat exchangers 9 where the reactant coolant is further cooled prior to entering a demineralizer 11. In the demineralizer 11 the reactant coolant is taken through a filter which removes the mineral deposits in the coolant. From demineralizer 11, some of the reactant coolant is routed back through the regenerative heat exchangers 7 and preheated prior to returning to reactor 3, and occasionally some of the reactant coolant is routed through a shutoff valve 13 from whence it is routed to a condenser 15 and possibly to a volume control tank (not shown).

Figure 2:
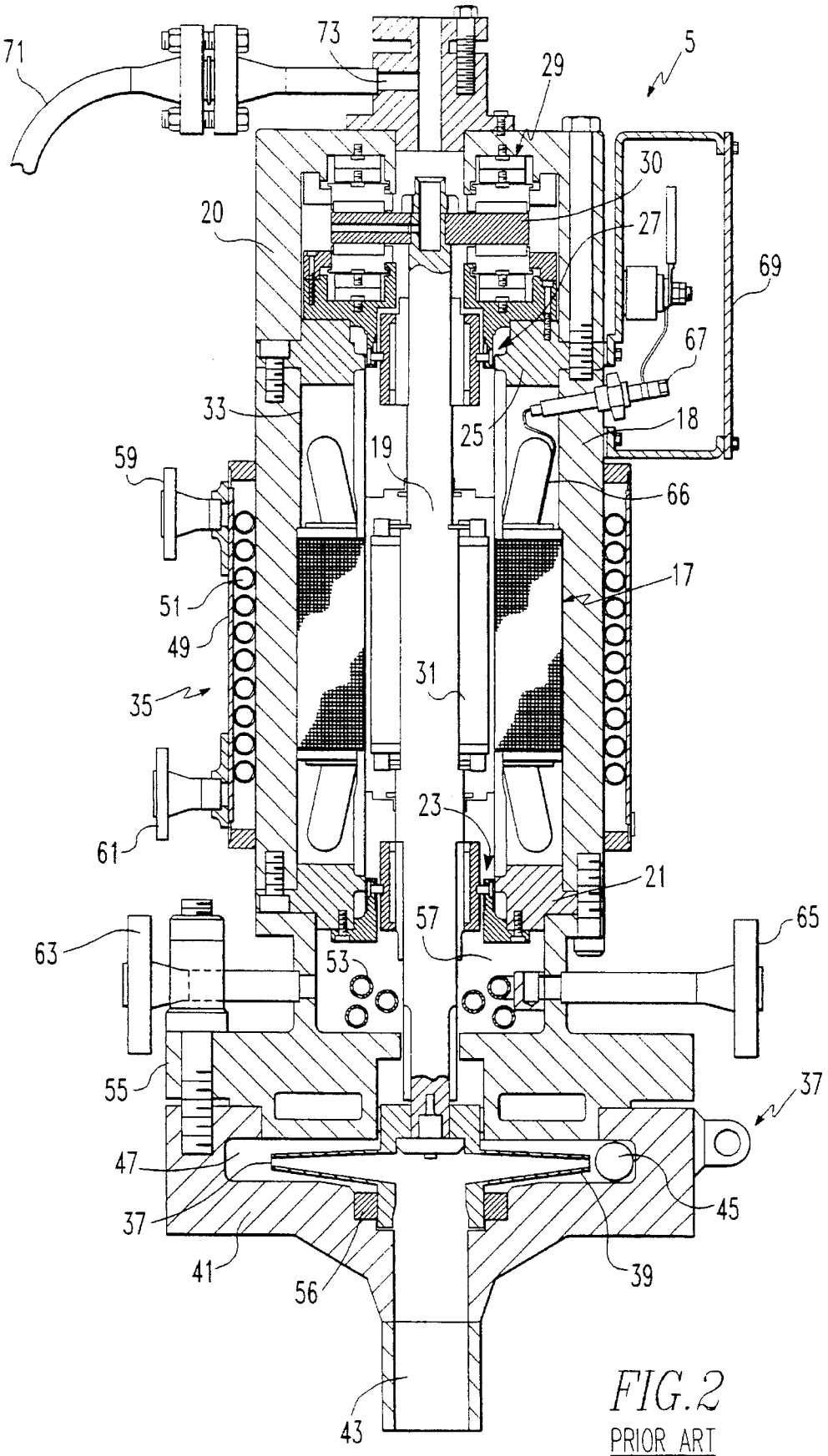
FIG. 2 PRIOR ART
FIG. 2 is a vertical sectional view of a reactor water cleanup pump of the prior art.

Referring now to FIG. 2, there is shown in greater detail one of the prior art reactor coolant pumps 5. Pump 5 has electric motor means 17 which includes casing 18, a shaft 19 extending axially through pump 5, and rotatably mounted in a lower annular plate 21 bolted to casing 18 by a pivoted pad radial bearing assembly 23 and in an upper annular plate 25 bolted to casing 18 by a pivoted pad radial bearing assembly 27; and a thrust bearing assembly 29, which has a thrust runner 30. Radial bearing assembly 27 and thrust beating assembly 29 are housed in casing 20 which is bolted to casing 18. Thrust bearing assembly 29 is a double-acting, pivoted pad, Kingsbury-type beating which is self-equalizing and which adequately absorbs thrust in both axial directions. Radial bearing assemblies 23 and 27 are generally made of Graphitar®, which is a carbon-graphite compacted material, and are self-aligning and designed to be lubricated by internal flow circuit water. Electrical motor means 17 is located about shaft 19 between the opposite lower and upper radial beating assemblies 23 and 27, and includes a canned rotor assembly 31 rotatably mounted to shaft 19 and a canned stator assembly 33 mounted stationarily to the casing 18 about rotor assembly 31.

For removing heat to cool the lower and upper bearing assemblies 23, 27, and 29 and motor means 17, the pump 5 also includes a heat removal arrangement 35 which is separate from the reactant coolant water being pumped by cleanup pump 5. Further, cleanup pump 5 has an impeller assembly 37 with an impeller 39 bolted to the lower end of shaft 19 in casing 41. Casing 41 has a central inlet nozzle 43, a peripheral outlet nozzle 45, and an annular passage 47 which interconnects inlet and outlet nozzles 43,45. The pump impeller 39 is disposed across annular passage 47 and in flow communication with reactor coolant water flowing in a main stream therethrough. Operation of electrical motor means 17 causes rotation of shaft 19, motor assembly 31 and impeller 39. Rotation of impeller 39 draws water axially through central inlet nozzle 43 from reactor 3 and discharges the water through discharge nozzle 45 and into the heat exchangers 7 in FIG. 1.

The heat removal arrangement 35 includes a hollow annular jacket 49 surrounding motor means 17, a set of coils 51 contained in jacket 49 and surrounding motor means 17, and a set of coils 53 located adjacent to radial bearing assembly 23, which are housed in a thermal barrier 55 bolted to casing 18 and which together with a labyrinth seal 56 in casing 41 minimizes heat transfer and fluid flow between impeller casing 41 and motor cavity 57, thus insulating motor means 17 from high system temperatures.

Annular hollow jacket 49 of heat removal arrangement 35 has a cold water inlet 59 and a water outlet 61 connected in flow communication with an external cold water source (not shown) of a secondary coolant fluid which can then flow through jacket 49 over the set of coils 51 through which an internal coolant fluid is circulated and by which the heat carried by the internal coolant fluid gained from cooling motor means 17 and bearings 27 and 29 is readily transferred to the secondary coolant fluid in the jacket 49. Thermal barrier 55 is bolted to impeller casing 41 and has a cold water inlet 63 and a water outlet 65. The sets of coils 51 and 53 may be interconnected to form a closed path for circulating the internal coolant fluid, and the outlet 61 of jacket 49 and inlet 63 of thermal barrier 55 may be in flow communication so as to define a closed path for circulation of the secondary coolant fluid over the sets of coils 51 and 53 for cooling the beating assemblies 23, 27, and 29 and motor means 17.

Electrical power is delivered to stator windings 66 through a terminal gland 67 in a terminal box 69 in a manner well known in the art.

A purge fluid line 71 is provided near thrust bearing assembly 29 for delivering an internal coolant fluid into cleanup pump 5 which flows into thrust bearing assembly 29 through channel 73 and into thrust runner 30 which acts as an impeller to force the fluid radially outwardly where it then flows through the lower bearings of thrust beating assembly 29. From thrust bearing assembly 29 the fluid flows into radial beating assembly 27, through the annular space created between canned rotor assembly 31 and canned stator assembly 33, through radial beating assembly 23, and into annular passage 47 of impeller casing 41 where the internal coolant fluid enters the main flowstream of the reactant coolant water being drawn through inlet nozzle 43 of impeller assembly 37.

Generally, the purge line 71 is connected to a clean water source which may be different from that connected to heat removal arrangement 35.

As discussed hereinabove, purge line 71 has typically been used at certain intervals, such as during start-up, hot standby, and shutdown operations.

Figure 3:
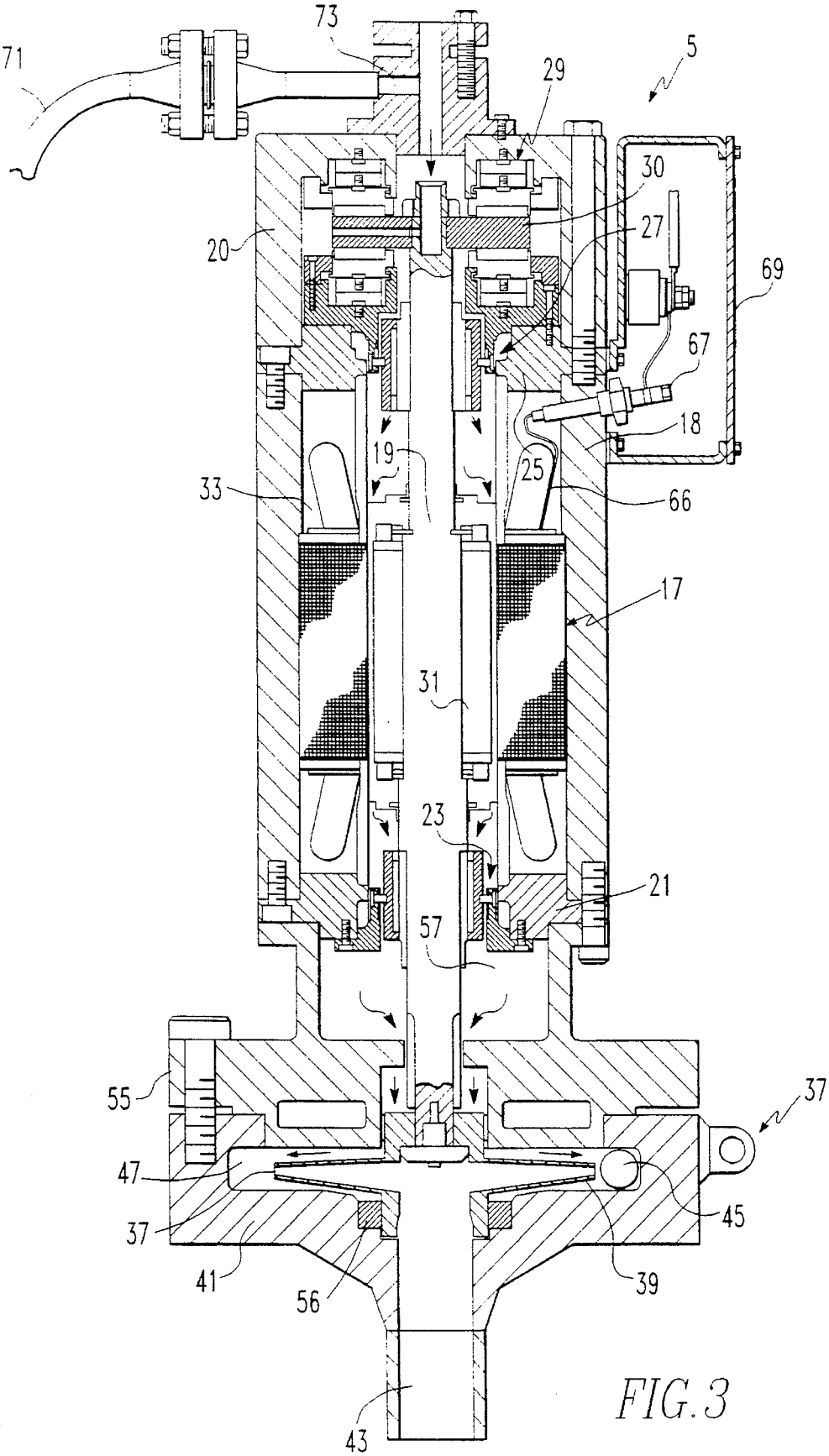
FIG. 3 is a vertical sectional view of a reactor water cleanup pump of the present invention.

Turning now to FIG. 3, them is illustrated an improved version of pump 5 in accordance with the principles of the present invention, which employs purge line 71 to continuously deliver internal coolant water into pump 5.

The present invention employs the purge fluid line 71 to cool bearing assemblies 23, 27, and 29 and electrical motor means 17. As shown in FIG. 3 by the arrows, the purge water is supplied into an inlet side of pump 5 and flows internally through the cleanup pump 5 along the same route as discussed hereinabove with regard to FIG. 2, the difference being that in the present invention the purge water is continuously being delivered therein, as the cleanup pump 5 is drawing in reactant coolant through inlet nozzle 43 and discharging it through outlet nozzle 45 of impeller assembly 37.

The purge fluid is provided by a clean water source located externally from pump 5.

An object of the invention is to be able to determine and control the volume of purge water which is needed to adequately remove the heat generated by electrical motor means 17 and the frictional heat generated in bearing assemblies 23, 27, and 29, thereby cooling these several components.

It has been envisioned by the inventor to base this volume on the input motor power and its efficiency, and other factors in the system.

In a particular reactor water cleanup system, the cleanup pump 5 may be designed to operate at a pressure of 1450 psig for drawing in through inlet 43 reactant coolant at a flow rate of about 480 gallons per minute and at a temperature of about 575° F. The inlet temperature for the purge water in purge feed line 71 may be about 130° F., and based on a motor input power of 80 kilowatts, it is estimated that the volume of purge water into purge feed line 71 must be about 4.5 gallons per minute to adequately cool bearing assemblies 23, 27, and 29 and motor means 17.

This estimate is calculated from the following equation:

$$Q_{out}=(\text{Unit Conversion Factor})\ (\text{Required Flow Rate})\ (\Delta T)\quad (1)$$

where $Q_{out}$ represents the amount of heat which is to be removed from cleanup pump 5, and ΔT represents the differential temperature defined as being the difference between a predetermined temperature of the purge fluid delivered into purge fluid line 71 and the desired temperature of said purge fluid exiting into the outlet side of the pump 5 and into the impeller assembly 37 of cleanup pump 5. If the units for $Q_{out}$ are BTU's, then the unit conversion factor for water to convert BTU's into gallons per minute which would be the units for the required flow rate in equation (1) above is 0.147. The equation (1) is then solved for the required flow rate.

The amount of heat $Q_{out}$ is determined from the following equation:

$$Q_{out}=(1.00-\%\ \text{efficiency})\ (\text{motor input power})\quad (2)$$

This equation (2) is based mainly on the heat losses of electrical motor means 17 since the frictional heat generated by bearings 23, 27 and 29 is minimal compared to the heat generated in motor means 17.

EXAMPLE NO. 1

For a motor input power of 80 kilowatts and an efficiency of 75%, the $Q_{out}$ which is the amount of heat to be removed from the cleanup pump 5 is 20 kilowatts when these values are substituted in Equation No. 2 above. That is:

$$Q_{out}=(1.00-0.75)\ (80\ \text{kilowatts})=20\ \text{kilowatts}\quad (3)$$

For the particular example above, the predetermined temperature of the purge fluid into purge fluid line 71 is 130° F. The desired temperature of the purge fluid exiting into impeller assembly 37 of cleanup pump 5 of FIG. 3 is 160° F. These values along with the other pertinent values, are substituted into Equation (1) to give the following:

$$20\ \text{Kilowatts}=(0.147)\ (\text{Required Flow Rate})\times(160°\ \text{F.}-130°\ \text{F.})\quad (4)$$

Solving this Equation No. 4, results in a required flow rate of 4.5 gallons per minute for the purge water in fluid line 71.

EXAMPLE NO. 2

Equation (1) can be used to estimate the required flow rate for a motor input power of 160 kilowatts, with the same set of variables as those for Example No. 1 above. Substituting these values in Equations (1), (2), (3), and (4) results in a required flow rate of 9.0 gallons per minute for the purge fluid in purge fluid line 71.

In the above two examples, an input temperature for the purge fluid was given as 130° F. It is to be appreciated that this temperature may range from 50° F. to 130° F. The desired temperature for the purge fluid flowing into impeller assembly was 160° F., which temperature is considered as being the limit established as good design practice.

From the teachings of the present invention, it is appreciated that the heat removal arrangement 35, including the sets of coils 51 and 53, of the cleanup pump 5 of the prior art of FIG. 2 is eliminated since in the present invention these components are no longer necessary for an adequate cooling of bearing assemblies 23, 27, and 29, and electrical motor means 17.

It can also be appreciated that in the present invention, the purge fluid from line 71 is the primary source of cooling for bearings 23, 27, and 29 and electrical motor means 17 in the pump 5, and that pump 5 is internally cooled with casing 18 of electric motor means 17 being exposed and cooled to some extent by the ambient air surrounding casing 18.

While a specific method and recited means of the invention have been described in detail, it will be appreciated by those skilled in the art that various modifications and alternatives to those details could be developed in light of the overall teachings of the disclosure. Accordingly, the particular method and means disclosed are meant to be illustrative only and not limiting as to the scope of the invention which is to be given the full breadth of the appended claims and any and all equivalents thereof.

In accordance with the patent statutes, we have explained the principles and operation of our invention, and have illustrated and described what we consider to be the best embodiment thereof.

What is claimed is:

1. A method for cooling electrical motor means of a reactor water cleanup pump of a boiling water reactor, said pump having an inlet side, an outlet side, and casing means having cavities containing bearings and said electrical motor means, the steps comprising:

delivering purge fluid into said inlet side of said reactor water cleanup pump at a desired flow rate and at a predetermined temperature, and allowing said purge fluid to flow into said cavities containing said bearings and said electrical motor means and into said outlet side of said reactor water cleanup pump at a desired temperature for said purge fluid, said delivering step, including the steps of:

continuously delivering said purge fluid at least during the operation of said pump, and determining said desired flow rate of said purge fluid based on at least the heat losses from said electrical motor means and a differential temperature defined as being the difference between said predetermined temperature of said purge fluid delivered into said inlet side of said pump and said desired temperature of said purge fluid exiting into said outlet side of said pump.

2. A method of claim 1, wherein said determining step for said desired flow rate is based on the following equation:

$$Q_{out}=\text{unit conversion factor}\times\text{desired flow rate}\times\Delta T$$

where $Q_{out}$ is said heat losses of said electrical motor means, and ΔT is said differential temperature for said purge fluid, and wherein said equation is solved for said desired flow rate.

3. A method of claim 1, the steps further comprising:

exposing said casing means for at least said electrical motor means to the ambient air surrounding said casing means while said continuously delivering said purge fluid through said cleanup pump.

* * * * *